US006108838A

United States Patent [19]

Connolly et al.

[11] Patent Number: 6,108,838

[45] Date of Patent: Aug. 29, 2000

[54] THERAPEUTIC BED

[75] Inventors: Patrick Joseph Connolly, Athlone; Eugene Keenan, Moate, both of Ireland

[73] Assignee: Alliance Investments Limited, Athlone, Ireland

[21] Appl. No.: 08/913,153

[22] PCT Filed: Feb. 26, 1996

[86] PCT No.: PCT/IE96/00009

§ 371 Date: Sep. 8, 1997

§ 102(e) Date: Sep. 8, 1997

[87] PCT Pub. No.: WO96/27356

PCT Pub. Date: Sep. 12, 1996

[30] Foreign Application Priority Data

| | | | |
|---|---|---|---|
| Mar. 8, 1995 | [IE] | Ireland | 950172 |
| Apr. 24, 1995 | [IE] | Ireland | S950292 |
| Nov. 8, 1995 | [IE] | Ireland | 950860 |

[51] Int. Cl.[7] ..... A61G 7/008; A61G 7/018

[52] U.S. Cl. ..... 5/609; 5/607

[58] Field of Search ..... 5/609, 607, 600

[56] References Cited

U.S. PATENT DOCUMENTS

| | | | |
|---|---|---|---|
| 3,434,165 | 3/1969 | Keane | 5/609 |
| 4,868,937 | 9/1989 | Connolly | 5/609 |
| 5,299,334 | 4/1994 | Gonzalez | 5/610 |

FOREIGN PATENT DOCUMENTS

| | | |
|---|---|---|
| 0315438 | 5/1989 | European Pat. Off. . |
| WO85/00967 | 3/1985 | WIPO . |

*Primary Examiner*—Alexander Grosz

*Attorney, Agent, or Firm*—Jacobson, Price, Holman & Stern, PLLC

[57] ABSTRACT

A therapeutic hospital bed (1) comprises a patient support platform (2) rotatably and pivotally secured within a main bed frame (3). The main bed frame (3) is supported on a base frame (5). An end board on the patient support platform (2) has an arcuate track (14) engaged by a drive belt (15) which is connected to a drive motor for oscillating the patient support platform (2) relative to the main bed frame (3). Opposite ends of the drive belt (15) are connected to disengagement arms (18, 25) which are pivotally interconnected to form a scissors mechanism. The arms (18, 25) are operable to tension or release the belt (15) to engage or disengage drive to the patient support platform (2). A spring (27) extends between the arms (18, 25) to bias the arms (18, 25) into a belt tensioning position. To disengage the drive for turning the patient support platform (2) manually, the arms (18, 25) are movable against spring bias to a disengaged position. When the arms (18, 25) are subsequently released the spring (27) returns the arms (18, 25) to the belt tensioning position to engage the drive.

20 Claims, 17 Drawing Sheets

THERAPEUTIC BED

The invention relates to hospital beds and more particularly to therapeutic beds.

Therapeutic beds are used for chronically ill patients such as paraplegics, patients that are partially or fully paralysed, patients suffering from head injuries or other serious injuries particularly spinal injuries. Such beds are used either to render a patient incapable of voluntary movement or to restrict some movements. Patients who are confined in this way however suffer among other things from constipation, muscular wasting, bone decalcification and bed sores.

It has been found that one way of overcoming these problems is to provide a therapeutic hospital bed in which the patient supporting platform is mounted for controlled oscillation or controlled rotation within a bed frame relative to a bed support on which the bed frame is mounted.

U.S. Pat. 3434165 & 4868937 describe therapeutic beds of this type.

One of the problems with known beds of this type is that due to incorrect use there is a possibility that the bed may be operated in such a way that the oscillation motion is not controlled. This could lead, in extreme circumstances where a patient is not adequately secured in the bed, to patient injury.

The present invention is therefore directed towards providing an improved therapeutic bed which will overcome these problems.

According to the invention there is provided a therapeutic bed comprising a patient support platform pivotally mounted to a main bed frame, a motor drive for oscillating the patient support platform relative to the main bed frame, a drive connection and activating means for engaging and disengaging the drive connection wherein the actuating means comprises a release mechanism which is biassed into a normally engaged position.

In a particularly preferred embodiment of the invention the release mechanism comprises at least one disengagement arm having a handle, the arm being biassed into a normally engaged position.

In one embodiment of the invention the release mechanism comprises a pair of disengagement arms.

In a particularly preferred arrangement the disengagement arms are interconnected by a scissors linkage.

In one arrangement the drive connection is connected to the disengagement arms adjacent the free ends thereof.

In a particularly preferred embodiment of the invention the disengagement arms are movable between inner and outer limit stops which limit the movement of the arms.

In this case preferably in the normally engaged position the disengagement arms engage the inner stops.

In one particularly preferred embodiment of the invention the biassing means comprises a spring biassing means.

In one case the drive connection comprises a drive belt.

In this case preferably tension of the drive belt is adjustable by an adjustment means. The adjustment means may for example comprise a turn-buckle.

In another aspect, the invention provides a therapeutic bed having means for mounting a photographic cassette adjacent an upper side of the patient support platform. This advantageously facilitates the taking of X-Rays of a patient on the patient support platform. Further, it allows imaging equipment to be used when required without moving the patient.

In a preferred embodiment the mounting means has means for de-mountably loading the cassette on the patient support platform from an under-side of the patient support platform. Thus advantageously medical staff have ready access for mounting and removal of a photographic cassette on the patient support platform.

Conveniently an opening is provided in the patient support platform for reception of the photographic cassette, and support means is provided for mounting the photographic cassette within the opening. Ideally, means is provided for supporting the cassette substantially flush with an upper-side face of the patient support platform. Thus advantageously the cassette can be positioned close to the patient without the patient support platform obstructing the X-Ray image made on the cassette.

In a preferred embodiment, the support means is a flap mounted at the opening, the flap movable between an open cassette loading position and a closed position extending across the opening.

Preferably the flap is mounted at the opening by a hinge. Ideally the hinge comprises a hinge pin on one of the patient support platform and the flap, the hinge pin pivotally engagable within an associated bushing on the other of the patient support platform and the flap, the hinge pin being movable between a retractable released position and an extended bushing engaging position, the pin being biased towards the bushing engaging position.

Conveniently a pair of spaced-apart hinges are provided, the hinges being positioned to allow single handed engagement and movement of the hinge pins to the release position. Thus conveniently medical staff can open the flap with one hand leaving the other hand free for mounting or removal of the cassette on the flap.

In a preferred embodiment the flap is hingedly mounted on opposite sides of the patient support platform thus ready access is provided from either side of the bed for loading and removal of a cassette.

According to another aspect of the invention there is provided a therapeutic bed having a patient support pad mounted on the bed by a mounting means which is operable for movement of the pad in two separate directions for positional adjustment of the pad relative to the patient support platform, and locking means for releasably locking the pad on the bed.

Thus, conveniently when the locking means is released the pad can be readily easily adjusted and positioned for comfort and support of the patient and then locked in a desired support position.

In a preferred embodiment the locking means comprises an associated pair of cams, each cam controlling movement of the pad in one of the directions, the cams having a common operating lever for simultaneous movement of both cams between an engaged locking position and a released position. Thus, conveniently medical staff only require one hand to engage and release the locking means leaving the other hand free for adjustment of the pad.

In another embodiment the cams are mutually perpendicular.

In a preferred embodiment the pad is rotatably mounted on a support bracket, the support bracket being slidably mounted on a support arm on the bed, the cams being operable to control rotation of the pad on the support bracket and sliding movement of the bracket on the support arm.

In a particularly preferred embodiment the cams comprise a cylindrical body eccentrically mounted by a pivot pin on the mounting bracket, an outer circumferential surface of the body forming a first cam for engagement with the support arm to control sliding movement of the bracket on the support arm, a second cam being formed on a side face of the body, the second cam being operable to control rotation of the pad on the mounting bracket.

Conveniently the pad is rotatably mounted an the mounting bracket by means of the pivot pin.

In a particularly preferred embodiment the mounting bracket is of U-shaped construction having an inner end with a pair of outwardly extending arms, the pivot pin rotatably mounted between the arms and carrying the cam body between the arms, the support arm passing between the body and the inner end of the bracket, rotation of the cam body on the mounting bracket moving the first cam between an engaged position and a released position, in the engaged position the first cam clamping the arm between the body and the inner end of the bracket, rotation of the cam body on the mounting bracket simultaneously moving the second cam between an engaged position and a released position, in the engaged position the second cam spreading apart the arms of the mounting bracket to engage associated stops on the pivot pin to releasably clamp the pad on the mounting bracket.

In a further aspect the invention provides a therapeutic bed having a delicate instrument mounting bracket mounted on the bed at or adjacent a longitudinal axis of the bed. Thus advantageously the delicate instrument mounting bracket is located on the bed in a position which minimises movement of the bracket as the patient support platform rotates. This is particularly important when the patient has sustained injuries to the head or neck which require drainage tubes. By position the bracket near the head of the patient movement of these tubes is minimised reducing the risk of entanglement and adding to patient comfort.

Conveniently the mounting bracket is de-mountably engagable with the bed.

In a preferred embodiment the mounting bracket comprises a support body having at least one mounting arm on the body, the or each arm having a clamp for releasable locking engagement with an associated clamp mount on the bed.

Preferably the clamp mount comprises a pair of spaced-apart posts, the clamp having a pair of jaws, namely a fixed jaw and a movable jaw, the jaws engagable with opposite sides of the posts for clamping the posts between the jaws, the movable jaw being movable on the arm between a mounting position for insertion between the posts and a clamping position for engagement with both posts.

Ideally a pair of spaced-apart mounting arms are provided on the support body.

According to another aspect of the invention there is provided a control system for a therapeutic hospital bed of the type having a patient support platform mounted for controlled oscillation within a bed frame relative to a bed support on which the bed frame is mounted the control system having a user interface for entry of desired parameters, a controller for controlling movement of the patient support platform relative to the bed support and drive means for actuating movement of the patient support platform in response to a signal from the controller. Thus, control of the patient support platform may be achieved in a relatively inexpensive and simple to operate manner and may incorporate all required safety functions, obviating the potential hazards that exist with current therapeutic beds of this type.

Preferably the controller has a logic unit communicating with the user interface and the drive means, the logic unit having at least two sensors for determining patient support table status. In this way the controller may easily determine the status of the bed and may quickly respond to an error condition.

Preferably at least one sensor is a rotary encoder thereby providing the sensor in a relatively simple manner.

In one arrangement the rotary encoder incorporates an optical interrupter with an associated motion detector.

Ideally the motion detector is a pendulum for actuating the optical interrupter in response to a movement of the controlled object. Thus, all information relating to the motion of the bed is conveyed to the logic unit utilising a minimum of components.

In one embodiment the controller includes at least one drive means actuator. Ideally the drive means actuator is a solid state switch. Thus, the controller is not subject to erroneous switching signals which could cause chatter and as there are no moving parts, mechanical noise is eliminated and overall reliability is increased.

Preferably the drive means actuator is a triac or mosfet advantageously providing high thermal stability for the controller.

In a preferred arrangement the controller and drive means are electrically isolated. Thus, there is no risk to operator or patient of electric shock from the drive means.

Ideally the controller and drive means are electrically isolated by an optical isolator allowing the required isolation to be achieved in a cost efficient manner.

In one embodiment the drive means includes an electrical motor for moving the patient support platform relative to the bed support. Preferably the drive means includes a hydraulic pump.

In a particularly preferred embodiment the controller incorporates an alarm actuator for signalling an error condition in the operation of the therapeutic hospital bed.

Preferably the user interface includes at least one user switch, a visual display unit and an alarm indicator. This allows the bed to be operated in a safe manner and clearly indicates an alarm condition. Further the cause of the alarm signal is clearly indicated to the operator.

Preferably the control system incorporates a battery backup unit for maintaining operation of the control system in the event of a power failure.

According to one aspect of the invention there is provided a controller for a therapeutic hospital bed the controller having a user interface for entry of desired parameters, a controller for controlling movement of a patient support platform relative to a bed support and drive means for actuating movement of the patient support platform in response to a signal from the controller.

According to another aspect of the invention there is provided a controller incorporating a rotary encoder for a therapeutic hospital bed, the rotary encoder having an optical interrupter with an associated motion detector for actuating the optical interrupter in response to a movement of a patient support platform.

The invention will be more clearly understood from the following description of some embodiments thereof given by way of example only with reference to the accompanying drawings in which.

Figure 1:
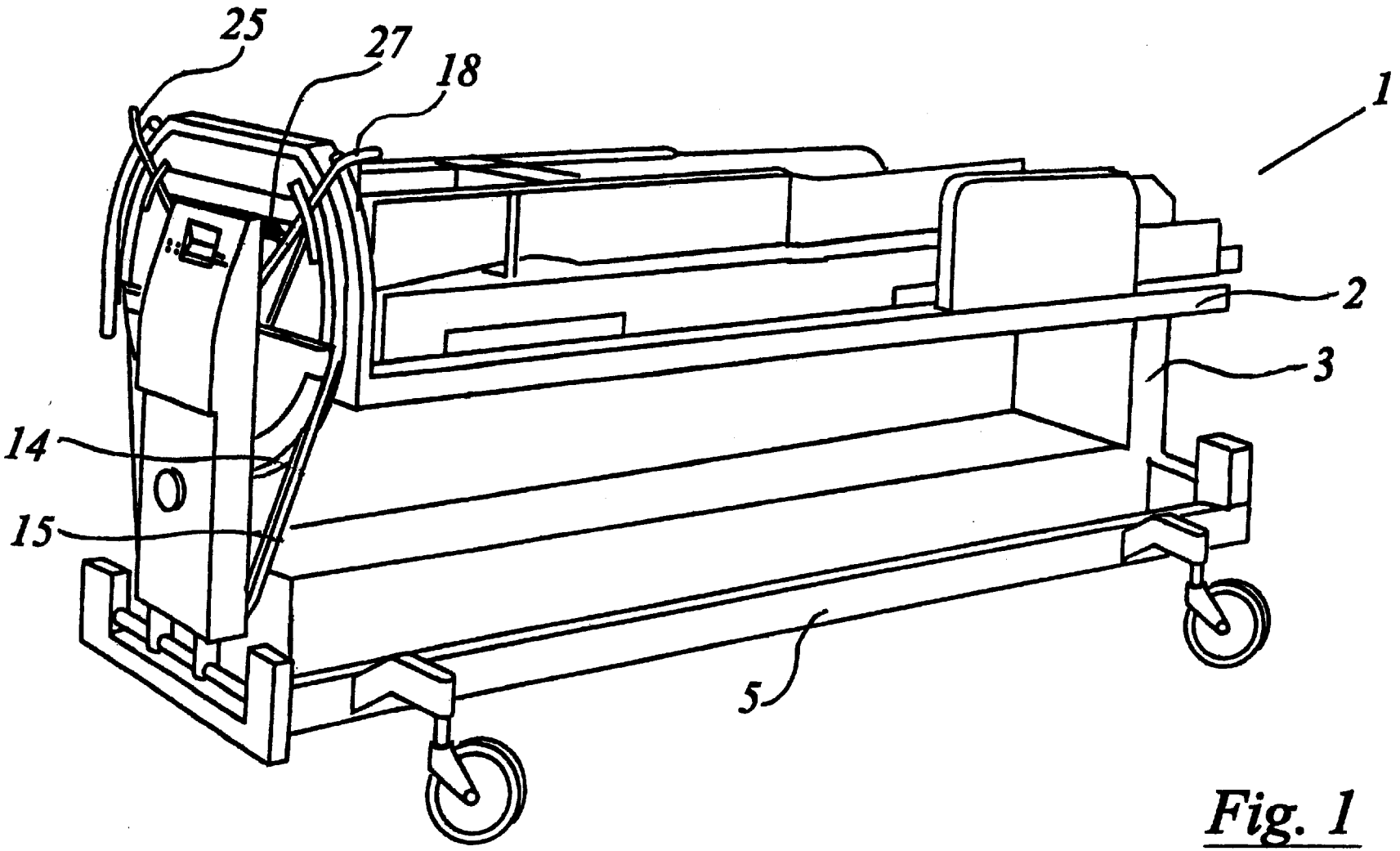
FIG. 1 is a perspective view of a therapeutic bed according to the invention.
Figure 2:
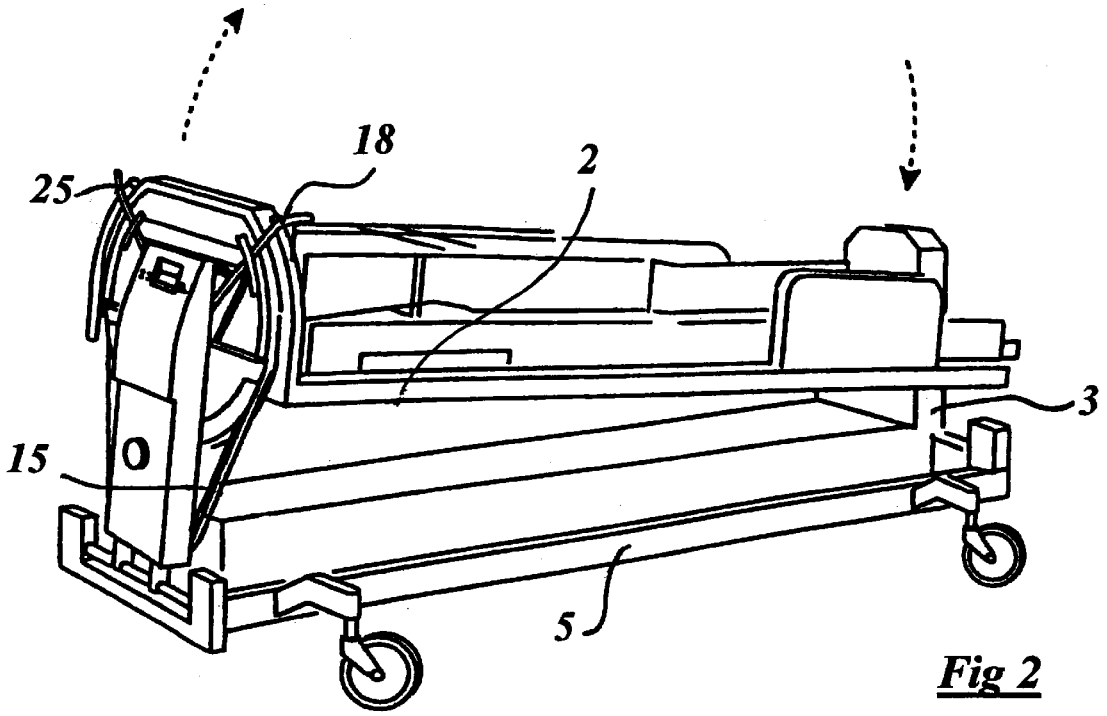
FIG. 2 is a perspective view of the bed showing a patient support platform of the bed in one position of use tilted about a transverse axis of the patient support platform.
Figure 3:
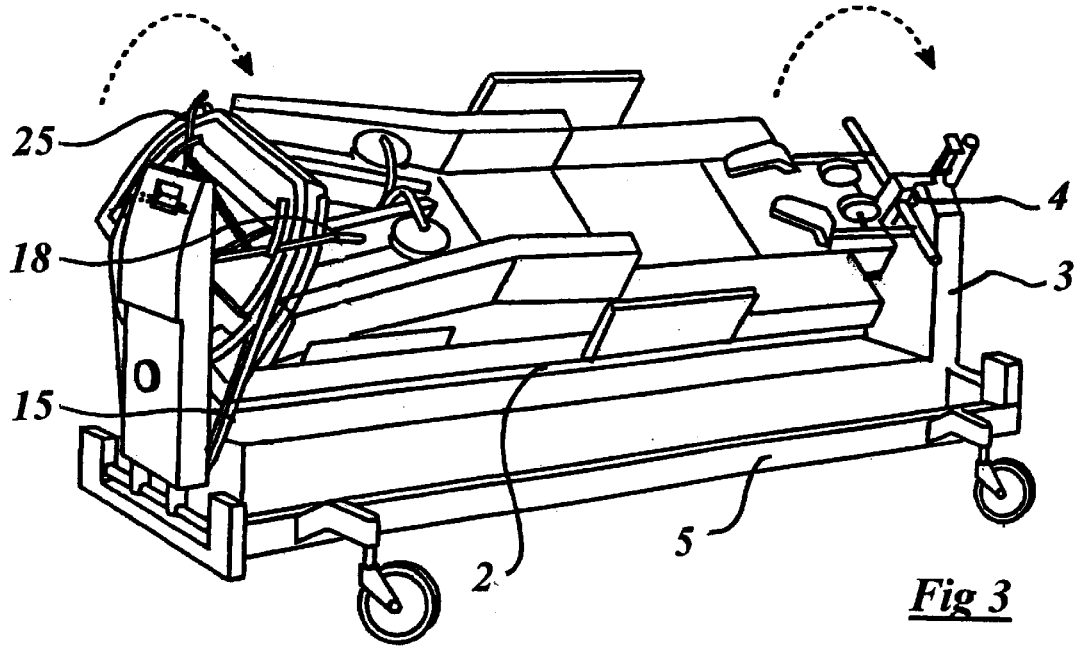
FIG. 3 is a perspective view of the bed showing a patient support platform of the bed in another position of use rotated about a longitudinal axis of the patient support platform.
Figure 4:
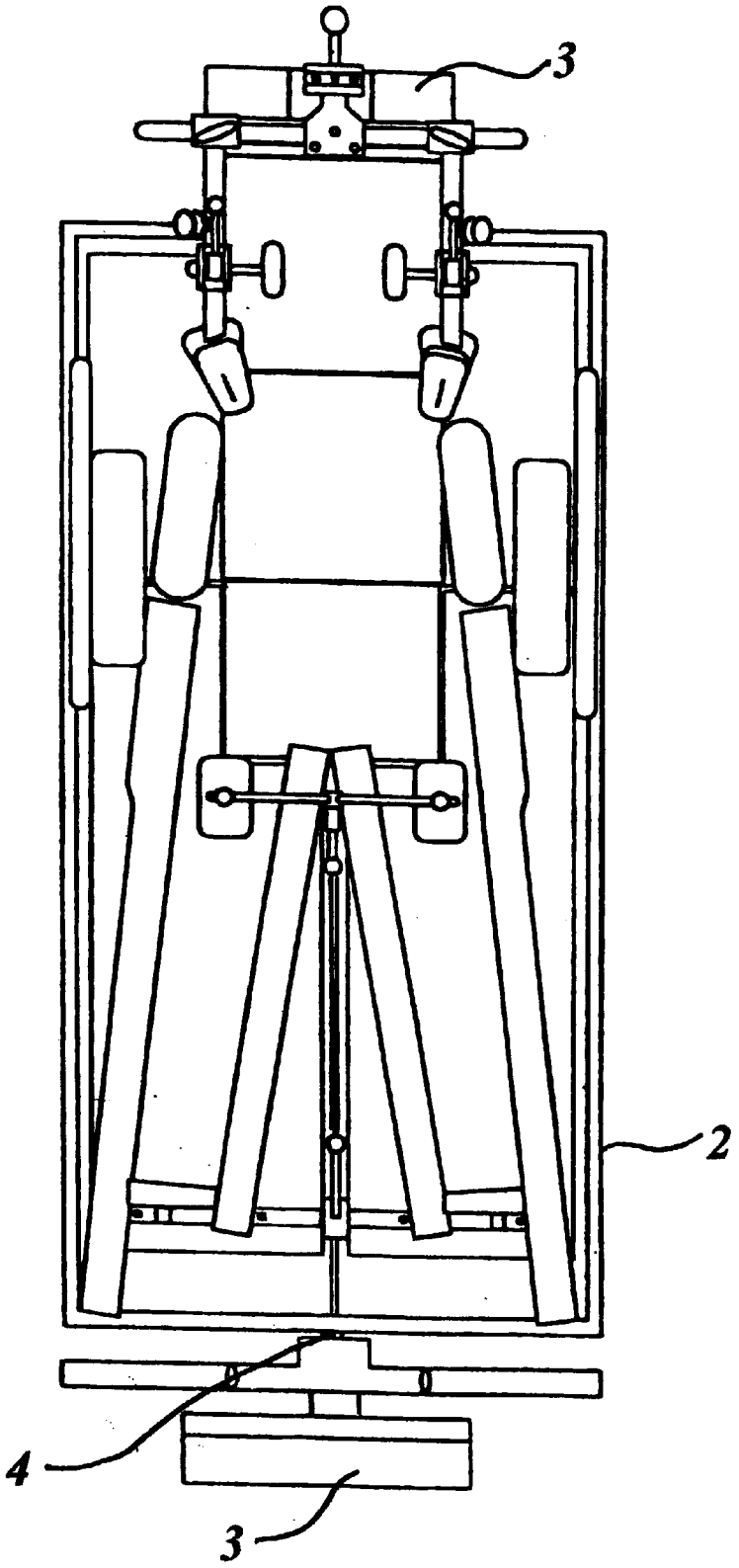
FIG. 4 is a plan view of the bed.
Figure 5:
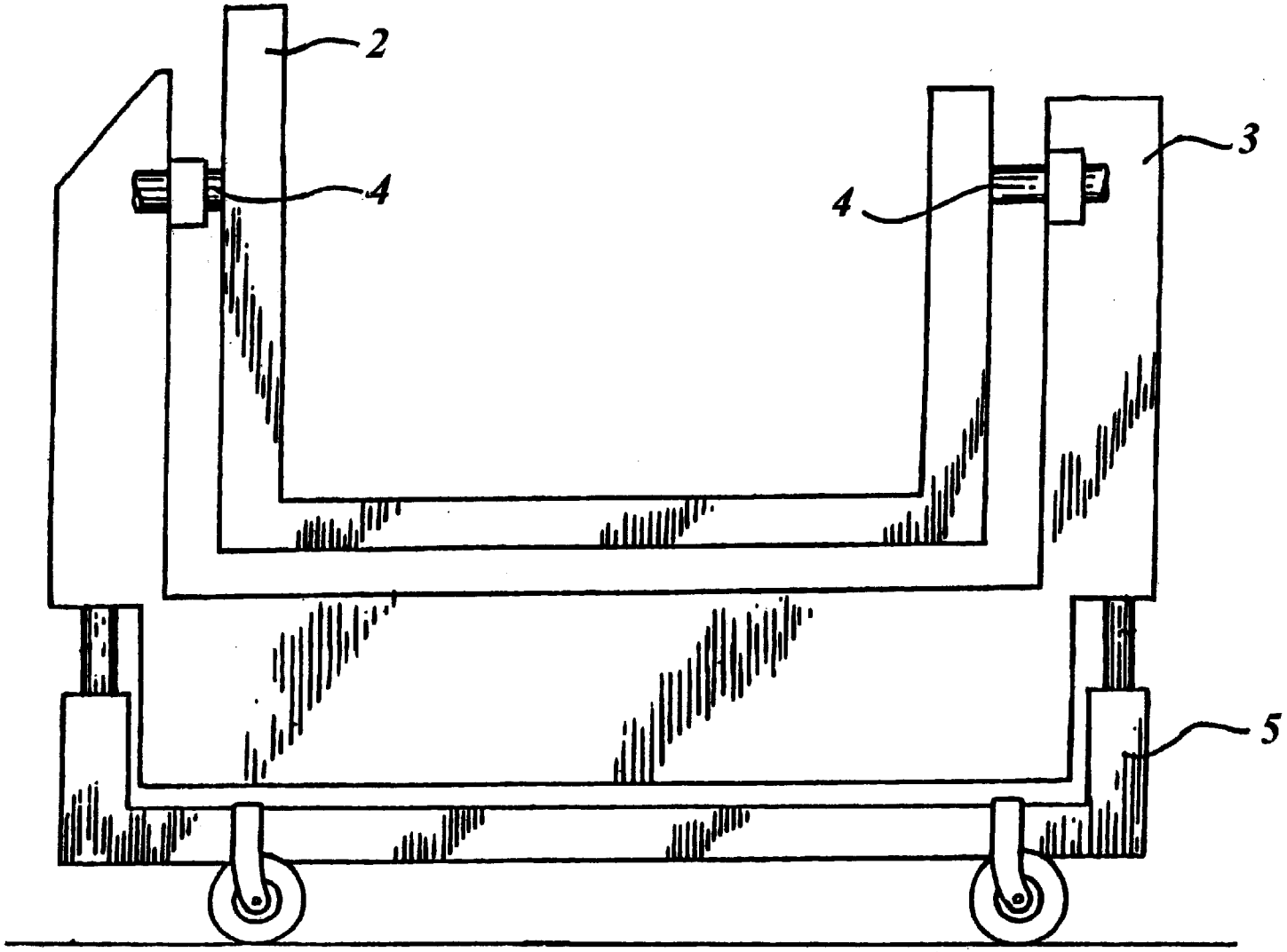
FIG. 5 is a schematic side view of the therapeutic bed.

Referring to the drawings, and initially to FIGS. 1 to 7 thereof, there is illustrated a therapeutic hospital bed according to the invention indicated generally by the reference numeral 1, comprising a patient support platform 2 rotatably and pivotally secured within a main bed frame 3 on pivot mountings 4. The main bed frame 3 is supported in a base frame 5.

Drive means for rotating the patient support platform 2 includes a combined electric motor and gear box having an output pulley 11. The combined motor and gear box is mounted by anti-vibration mountings on the main bed frame 3. An end board 13 is mounted on the patient support platform 2 and an arcuate track 14 is secured to the end board 13.

A drive belt 15 is trained over the output pulley 11 into the track 14, over a guide pulley 17, and one end of the belt 15 is pivotally secured at 16 to a free end of a first disengagement arm 18. The other end of the belt 15 is trained over another guide pulley 20 and is rigidly secured in a square tube 21. A first threaded bar 22 is welded to the square tube 21 and is connected to another threaded bar 23 by a turnbuckle 24. The second threaded bar 23 is pivotally connected at 23*a* to a free end of a second disengagement arm 25. The turnbuckle 24 is rotated to adjust the tension of the drive belt 15.

The disengagement arms 18,25 are pivotally interconnected by a stub shaft 26 to form a scissors mechanism. The stub shaft 26 is fixed to the end board 13 of the bed. The disengagement arms 18,25 extend beyond the end board 13 and define operating handles 18*a*,25*a* respectively. The disengagement arms 18,25 are coupled intermediate the ends thereof by a biassing means which in this case is a spring 27. The spring 27 biasses the disengagement arms 18,25 towards one another. Movement of the arms 18,25 is constrained between inner stops 28,29 and outer stops 30,31, respectively. The spring 27 biasses the arms 18,25 into engagement with the inner stops 28,29.

Figure 6:
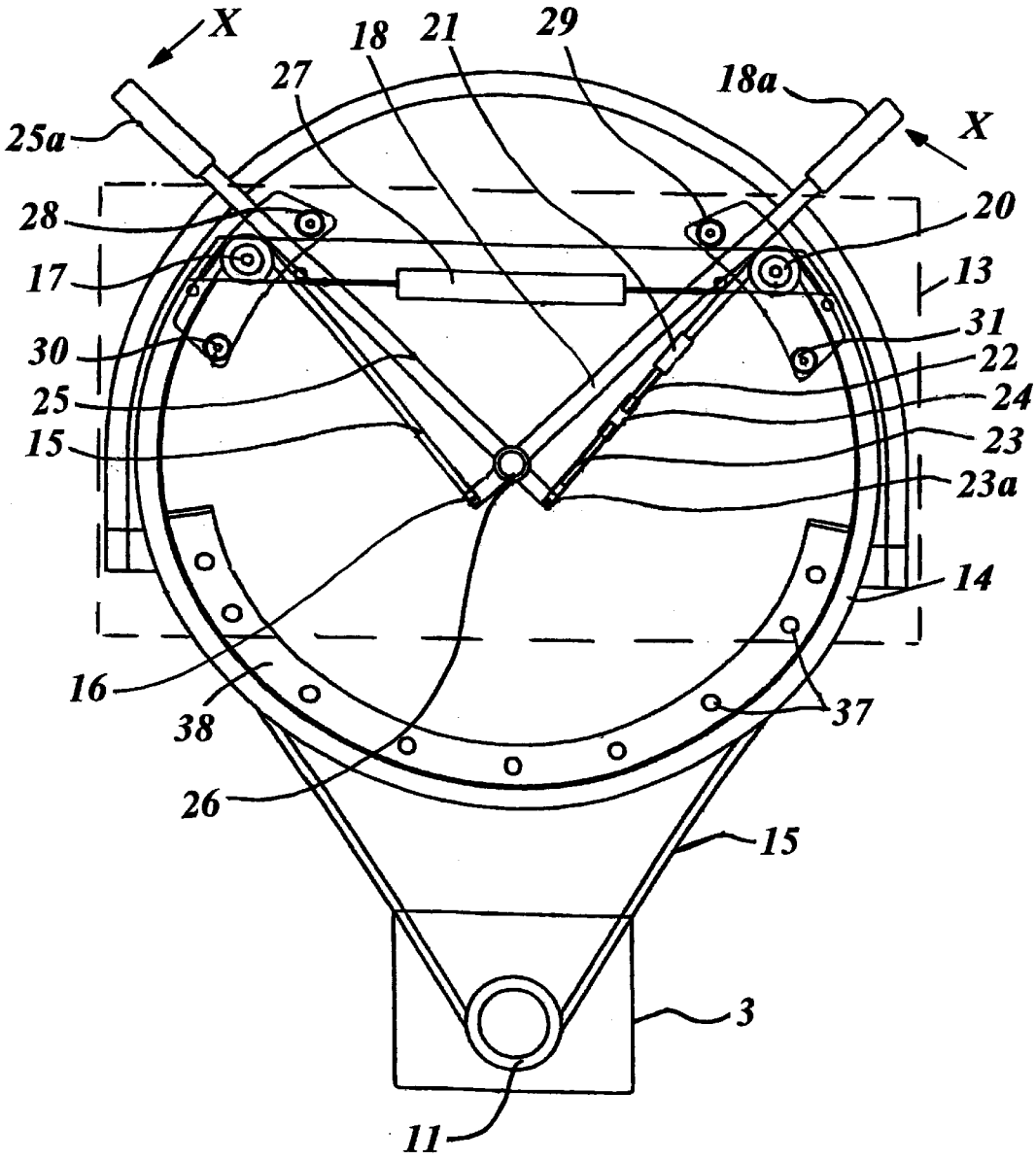
FIG. 6 is a schematic end view of part of the bed.
Figure 7:
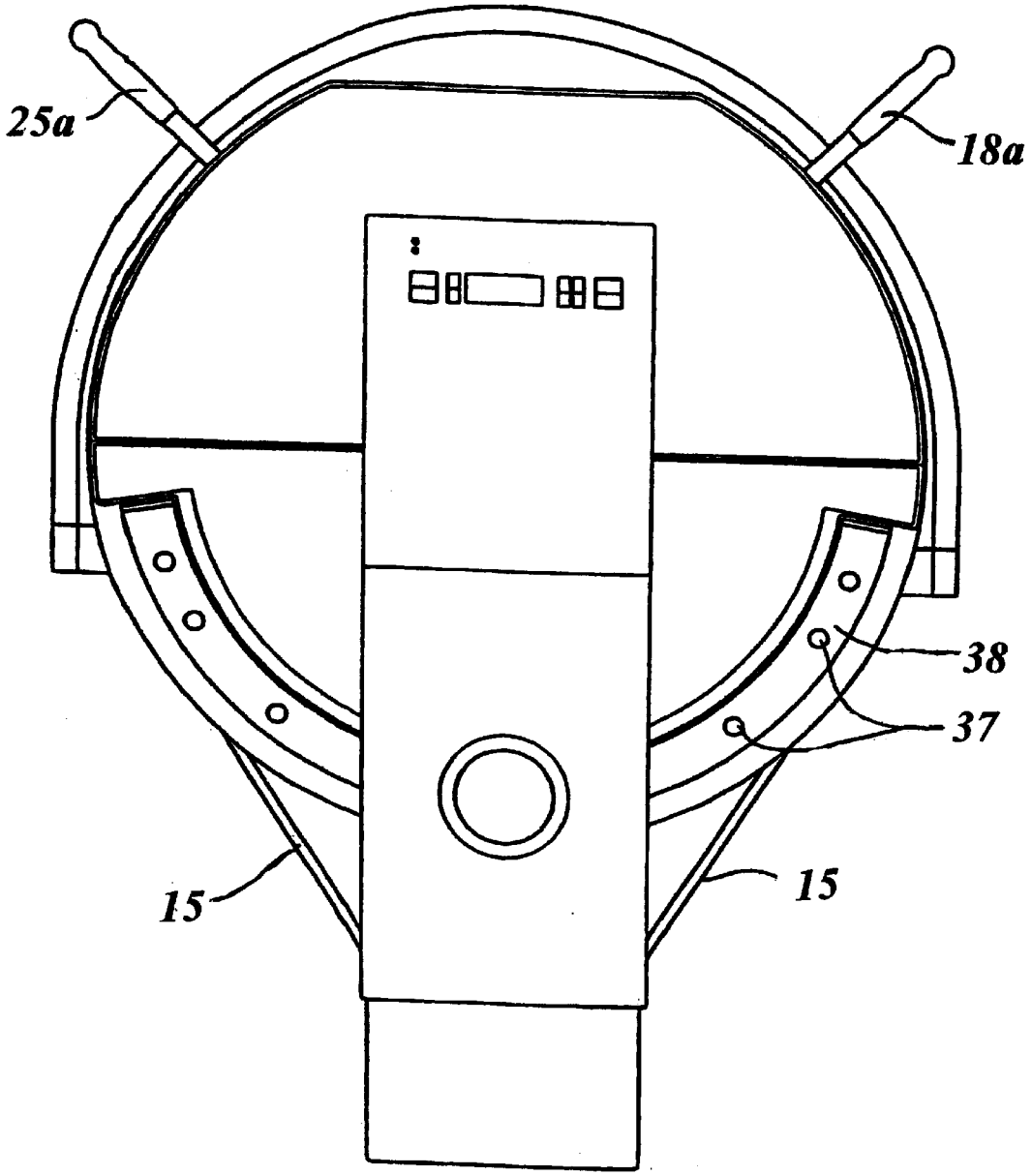
FIG. 7 is an end view similar to FIG. 6 with end covers in position.

To turn the bed manually, for example to the left as indicated by the arrows X in FIG. 6, the handle 18*a* is pushed against the stop 29 and the handle 25*a* is pushed downwardly against the biassing of the spring 27 towards the outer stop 30. The belt 15 is now disengaged from the drive pulley 11 allowing the bed platform to be turned manually. The position and use of the handles 18*a*,25*a* provides a substantial turning moment which facilitates ease of manually turning the bed platform. When the bed platform is in a desired position a locking pin (not shown) is inserted into the appropriate one of a number of receiving holes 37 on the semi-circular locking pin receiver 38.

When the locking pin is in position the handles 18*a*,25*a* are released and return to the normal rest position in which the arms 18,25 are engaged against the inner stops 28,29. In this position the drive is always engaged.

It will be appreciated that if a locking pin is released inadvertently the bed platform will not swing uncontrollably to the detriment of the patient.

Other details of the bed are similar to those described in U.S. Pat. No. 4,868,937.

Figure 8:
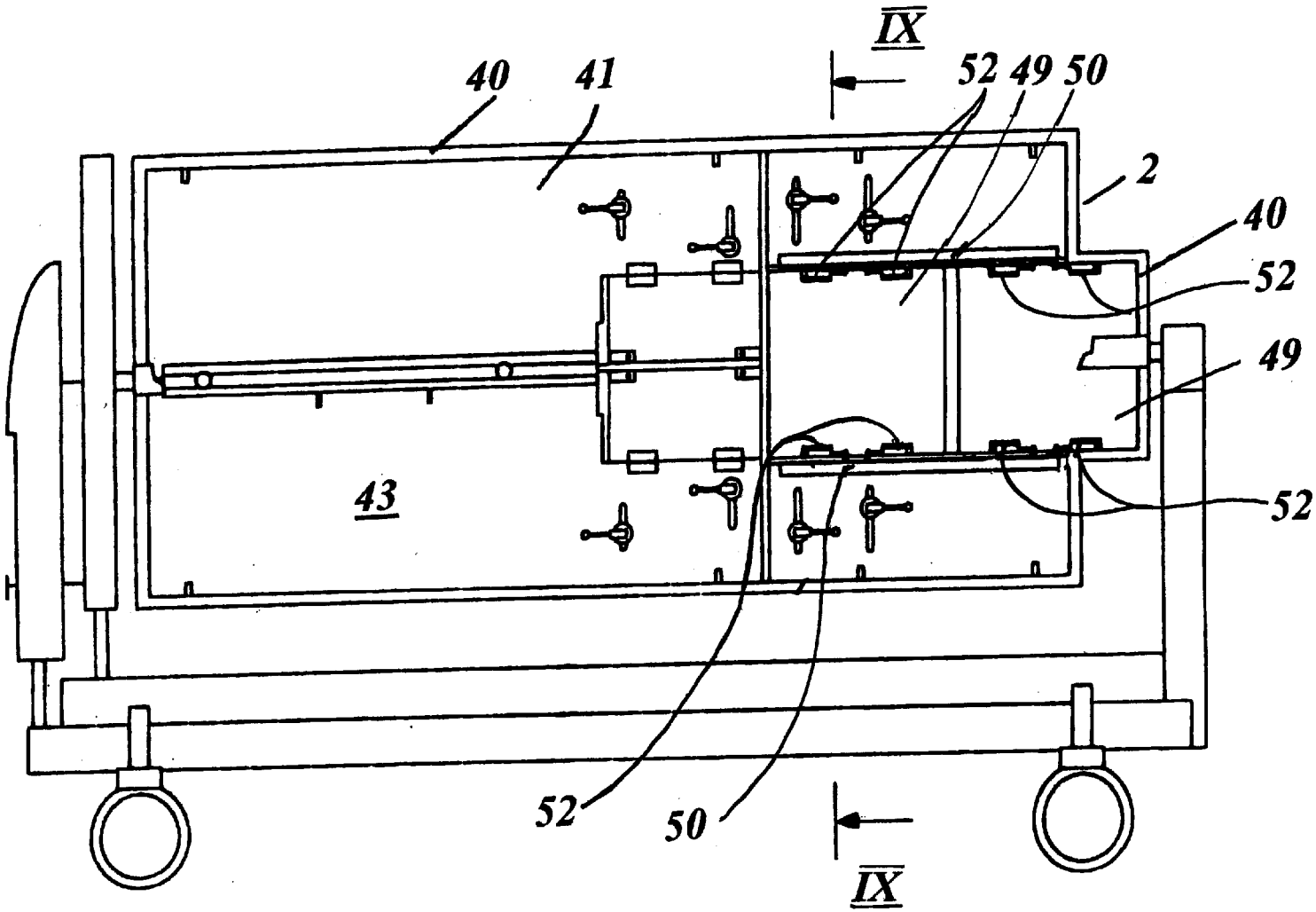
FIG. 8 is a side elevational view of the bed showing the patient support platform rotated into an upright position illustrating an underside of the patient support platform.
Figure 9:
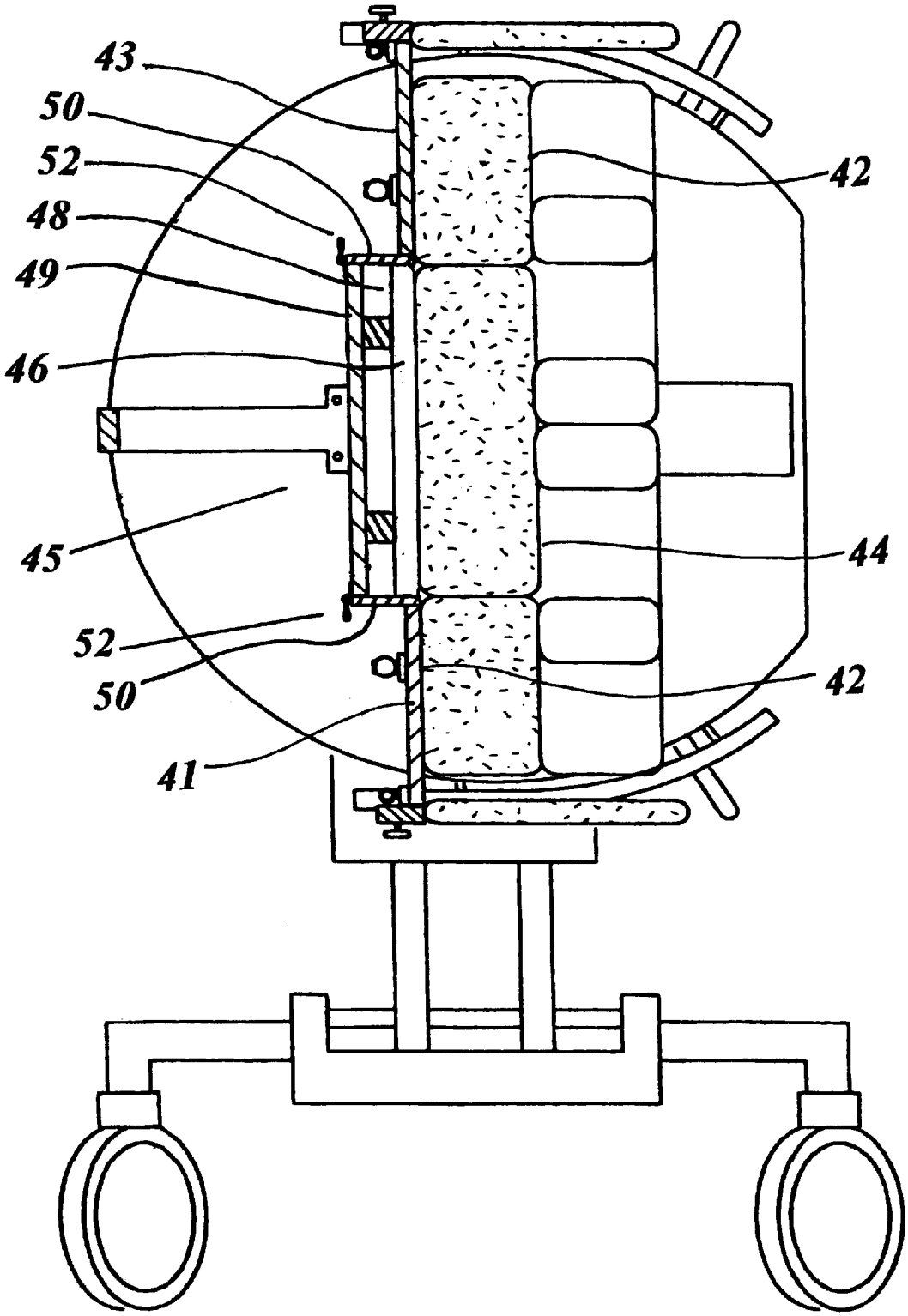
FIG. 9 is a sectional view taken along the line IX—IX of FIG. 8.
Figure 10:
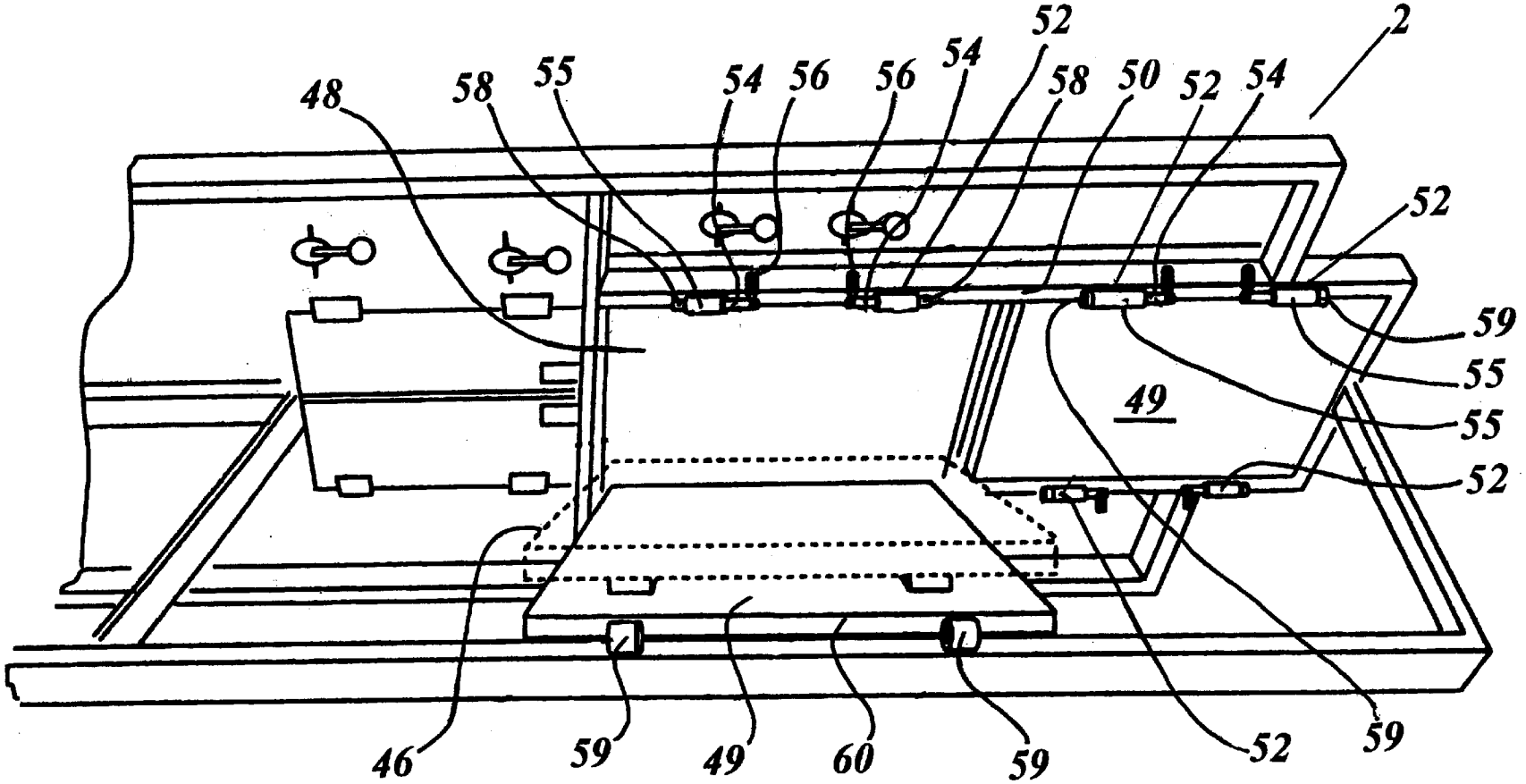
FIG. 10 is a detail perspective view showing an underside of the patient support platform.

Referring to FIGS. 8 to 10 the patient support platform 2 is shown in more detail. The patient support platform 2 comprises a generally rectangular tubular metal frame 40 on which are mounted wooden panels 41 forming a patient support platform with an upper face 42 and lower face 43. A mattress 44 is mounted on the upper face 42. The patient support platform 2 has means indicated generally by the reference numeral 45 for mounting a photographic cassette 46 adjacent the upper face 42 of the patient support platform 2. Said means 45 comprises an opening 48 forming a pocket for reception of the cassette 46. A flap 49 is mounted at a lower end of the opening 48 to support the cassette 46 within the opening 48. As can be seen in FIGS. 8 and 10 a pair of openings 48 closed by flaps 49 are provided for loading photographic cassettes 46 on the patient support platform 2.

Each flap 49 is attached to opposite side walls 50 of the opening 48 by pairs of hinges 52 mounted on each side wall 50. Each hinge 52 comprises a hinge pin 54 slidably mounted in a complimentary sleeve 55 mounted on the side wall 50. A lug 56 is provided at one end of the hinge pin 54 for sliding the hinge pin 54 in the sleeve 55. A free end 58 of the hinge pin 54 is pivotably engagable within an associated bushing 59 mounted along an edge 60 of the flap 49. A spring (not shown) mounted within the sleeve 55 urges the hinge pin 54 into engagement with the bushing 59. To open the flap 49 the lugs 56 of an associated pair of hinges 52 are gripped between a finger and thumb and squeeze together to disengage the hinge pins 54 from their associated bushings 55 allowing the flap 49 to pivot outwardly as shown in FIG. 10 on the pair of hinges 52 at the opposite side of the opening 48. Thus a photographic cassette 46 can be readily easily and quickly mounted within the opening 48 from either side of the patient support platform 2. Conveniently both hinges 52 of an associated pair of hinges 52 can be released using only one hand, leaving the other hand free for manipulating the flap 49 for loading and unloading the cassette 46. It will be noted that when a cassette 46 is loaded in the opening 48 it is supported substantially flush with the upper face 42 of the patient support platform 2. Thus a good quality image can be obtained on the photographic cassette 46 without interference from the patient support platform 2.

Referring to FIGS. 11 to 15 a patient support pad indicated generally by the reference numeral 70 is shown.

The pad 70 is rotatably mounted on a support bracket 71 which in turn is slidable along a support arm 72 mounted on the patient support platform 2. Locking means indicated generally at 74 is operable to release the pad 70 and bracket 71 simultaneously for adjustment on the arm 72 and for simultaneously locking the pad 70 and bracket 71 when the pads 70 have been positioned at a desired location for supporting a patient on the patient support platform 2.

The mounting bracket 71 is U-shaped, the construction having an inner end 76 with a pair of outwardly extending arms namely an inner arm 77 and an outer arm 78. It will be noted that a slot 79 is provided on an inner face of the outer arm 78 adjacent an upper end of the outer arm 78.

Figure 14:
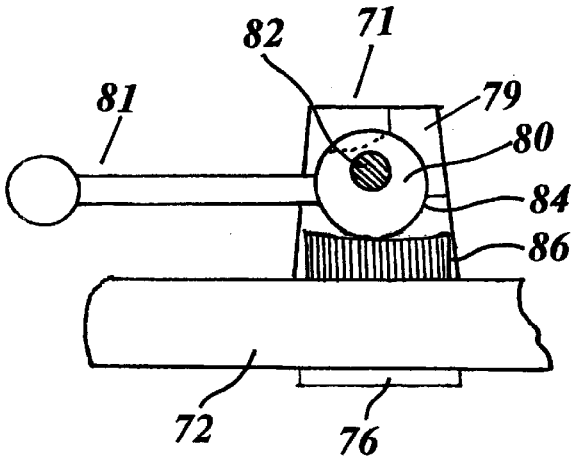
FIG. 14 is a view similar to FIG. 12 showing the locking mechanism in another position of use.
Figure 15:
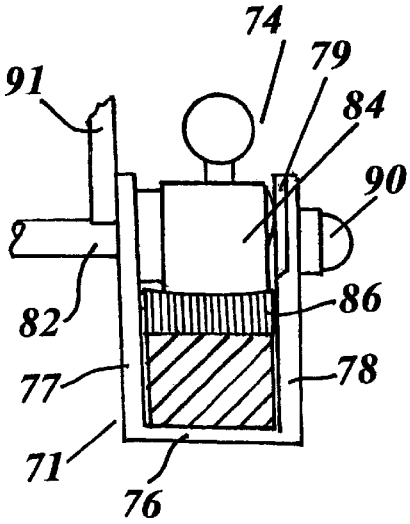
FIG. 15 is a view similar to FIG. 13 showing the locking mechanism in a position corresponding to that of FIG. 14.

The locking means 74 comprises a generally cylindrical body 80 with an operating lever 81 extending radially outwardly therefrom. The body 80 is rotatably mounted eccentrically between the arms 77, 78 of the bracket 71 by a pivot pin 82. An outer circumferential surface 84 of the body 80 forms a first cam movable between a released position shown in FIGS. 12 and 13 in which the bracket 71 is free to slide along the arm 72 and an engaged position as shown in FIGS. 14 and 15 in which the body 80 clamps the bracket 71 on the support arm 72. A resilient pad 86 is mounted between the first cam surface 84 of the body 80 and the arm 72 to prevent wear and to give added grip. A second cam 88 is formed on an outer side face 89 of the body 80. The cam 88 projects outwardly of the side face 89 and locates within the slot 79 when the body 80 is in the released position shown in FIGS. 12 and 13 allowing free rotation of the pivot pin 82 on which the pad 70 is mounted. When the body 80 is in the locked position as shown in FIGS. 14 and 15 the cam 88 spreads apart the arms 77,78 to engage associated stops on the pivot pin 82 formed by a retaining nut 90 and a mounting arm 91 for the pad 70.

Figure 12:
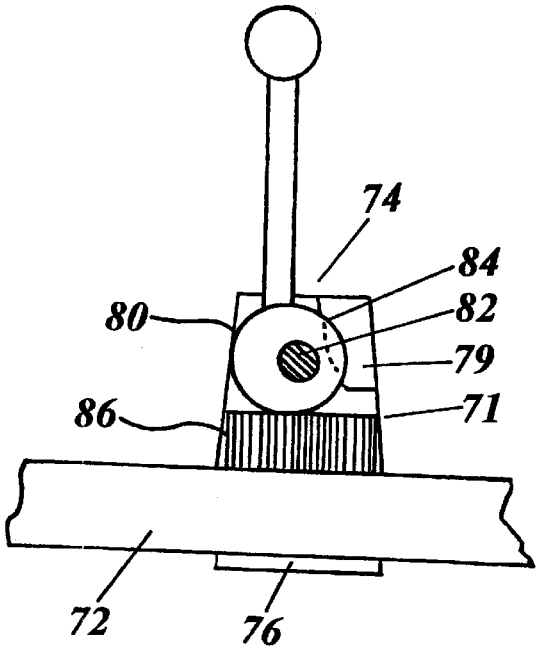
FIG. 12 is a detail sectional elevational view of a locking mechanism for positional adjustment of the support pad.
Figure 13:
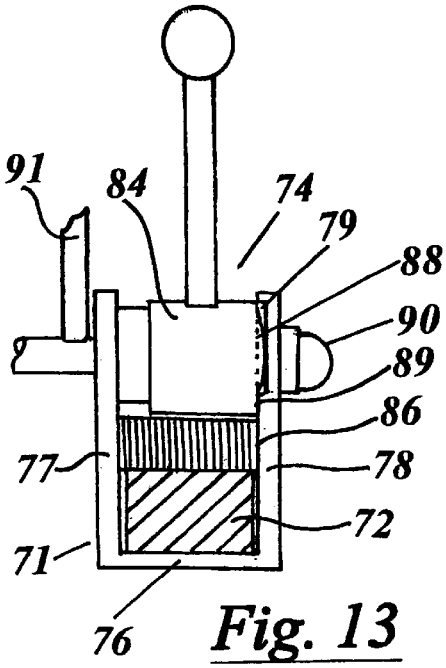
FIG. 13 is a detail partially sectioned end elevational view of the locking mechanism shown in FIG. 12.

In use, with the locking means 74 in the released position shown in FIGS. 12 and 13 the pad 70 can be positioned as desired by rotating the pad 70 on the bracket 71 and sliding the bracket 71 along the arm 72. By movement of the locking means 74 into the locked position shown in FIGS. 14 and 15 the pad 70 is locked on the bracket 71 and simultaneously the bracket 71 is locked on the arm 72. Thus an attendant adjusting the position of the pad 70 can operate the lever 81 with one hand to engage and disengage the locking means while at the same time manipulating the pad 70 as desired with the other hand.

Thus the pad 70 may be positioned as required in a relatively easy and quick manner and then locked in position.

Figure 16:
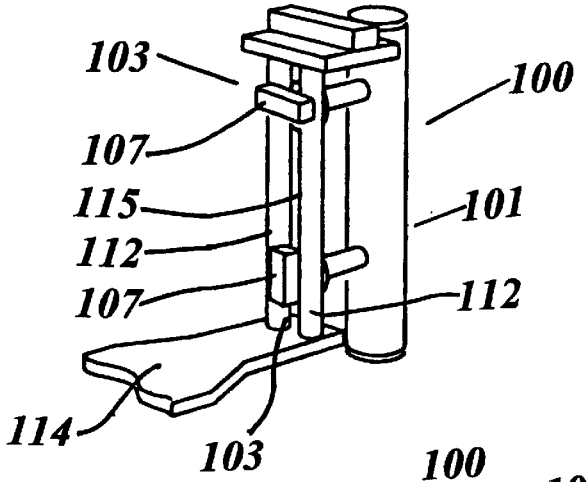
FIG. 16 is a perspective view of a delicate instrument mounting bracket for the bed.
Figure 11:
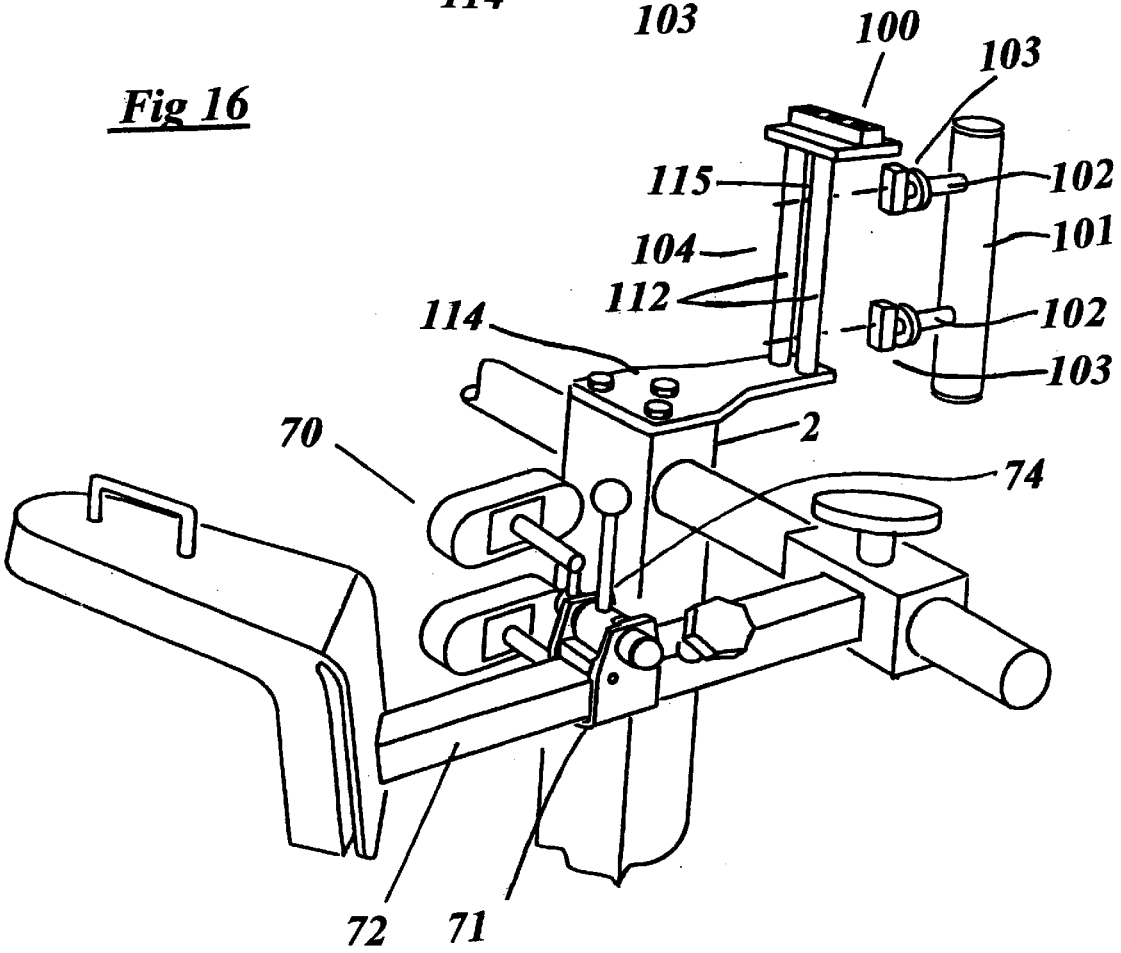
FIG. 11 is a detail perspective view showing a patient support pad for the bed.
Figure 17:
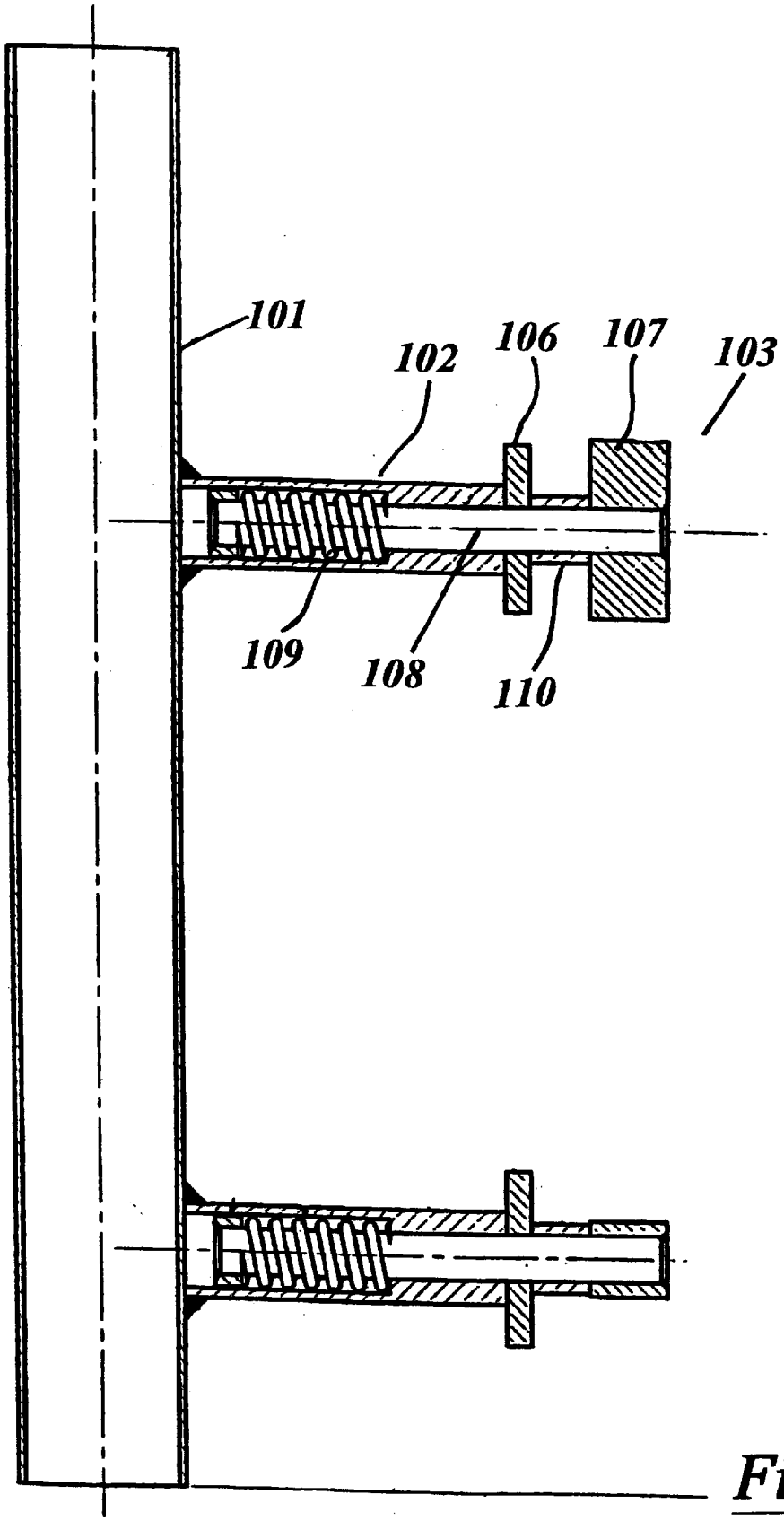
FIG. 17 is a sectional elevational view of the mounting bracket.
Figure 18:
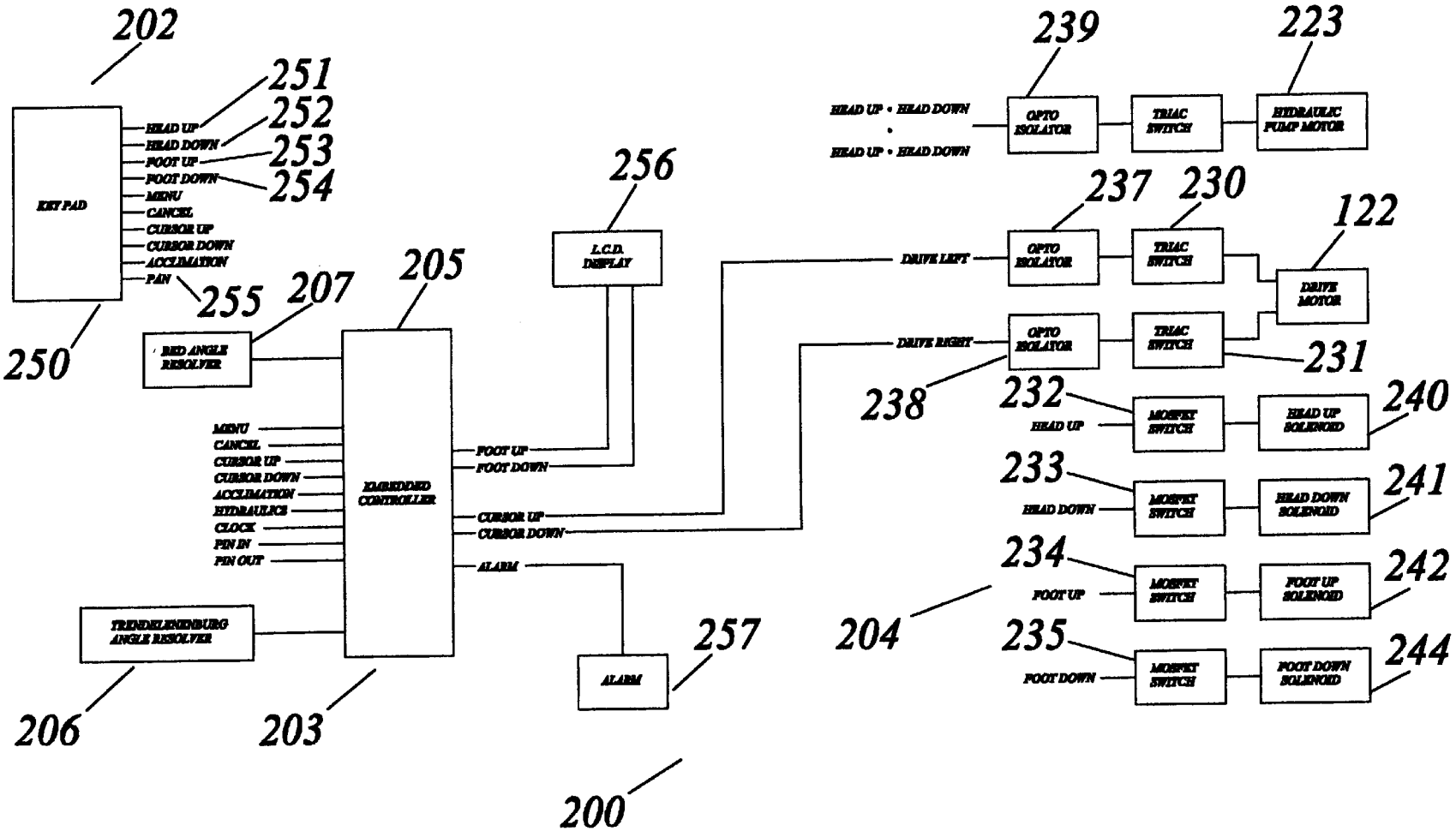
FIG. 18 is a block diagram of a bed control system according to the invention incorporating a controller.

Referring to FIGS. 11, 16 and 17 a delicate instrument mounting bracket 100 for the bed 1 is shown. The mounting bracket 100 has a cylindrical body 101 with a pair of spaced-apart mounting arms 102 projecting radially outwardly therefrom. A clamp 103 is provided at free end of each arm 102 for releasable locking engagement with an associated clamp mount 104 mounted on the patient support platform 2. It will be noted, particularly from FIGS. 3 and 4, that the clamp mount 104 is positioned such that the mounting bracket 100 is located centrally at one end of the bed generally along a longitudinal axis of the bed to minimise movement of the mounting bracket 100 as the patient support platform 2 rotates.

Each clamp 103 has a pair of jaws, namely a fixed jaw 106 and a movable jaw 107. As can be seen in FIG. 17 each arm 102 is hollow and the movable jaw 107 is mounted on the arm 102 by a rod 108 an inner end of which is pivotably and slidably mounted within the arm 102. A spring 109 housed within the arm 102 urges the rod 108 inwardly thus urging the movable jaw 107 towards the fixed jaw 106, the jaws 106, 107 being separated by a spacer 110. The associated clamp mount 104 comprises a pair of spaced-apart posts 112 upstanding on a mounting plate 114 which is secured on the patient support platform 2. The movable jaws 107 are aligned with a slot 115 formed between the posts 112 for insertion of the movable jaws 107 through the slot 115. Then by twisting the movable jaws 107 into a horizontal position as shown in the upper clamp in FIG. 16, the support body 101 is secured on the clamp mount 104.

Referring to FIGS. 18 to 22 there is illustrated a bed control system according to the invention indicated generally by the reference numeral 200 for controlling movement of the patient support platform 2 on the main bed frame 3.

The control system 200 has a user interface 202 for entry of desired parameters relating to the permitted range of movement of the patient support platform 2, a controller 203 for controlling movement of the patient support platform 2 relative to the main bed frame 3 in response to entered parameters and drive means, in this case provided by an electrical motor 222 and a hydraulic pump 223 for actuating movement of the patient support platform 2 relative to the bed frame 3 in response to a signal from the controller 203.

The controller 203 has a logic unit 205 communicating with the user interface 202 and the drive means, the logic unit 205 having two sensors provided by rotary encoders 206, 207 for determining the position of the patient support platform 2 relative to the bed frame 3.

Figure 19:
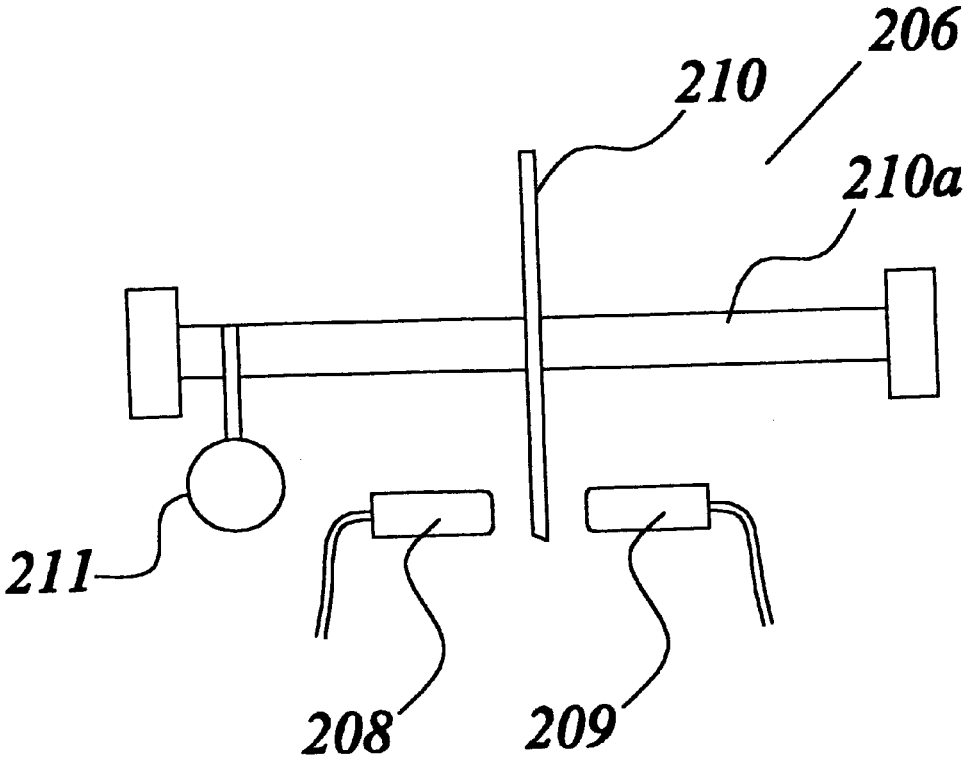
FIG. 19 is a side view of a rotary encoder forming part of the controller.

In more detail and referring now to FIG. 19 the rotary encoder 206 has an infra red transmitter 208, an infra red receiver 209 mounted on the bed support and an interposed optical interrupter provided in this case by a disk 210 divided into three hundred and sixty segments mounted on an axle 210*a* which in turn is movably mounted on the patient support platform 2. The disk 210 has an associated motion detector provided by a pendulum 211 carried on the axle 210*a* for moving the actuating the disk 210 relative to the infra-red transmitter 208 and receiver 209.

The logic unit 205 of the controller 203 controls the operation of the electrical motor 222 and the hydraulic pump 223 by means of seven drive means actuators. The drive means actuators are provided in this case by two triacs 230, 231 for controlling an electrical motor 222 and five mosfets 232, 233, 234, 235, 236. The mosfets 232, 233, 234, 235, each controlling operation of one solenoid, namely 240, 241, 242 and 244 respectively in response to a signal from the logic unit 205. Each of the solenoids 240, 241, 242, 244 in turn controlling the operation of a hydraulic pump 223.

Electrical isolation between the logic unit 205 and the motor 222 is provided by optical isolators 237, 238 attached to the triacs 230 and 231 respectively and similar optical isolation is provided between the logic unit 205 and the hydraulic pump 223 by an optical isolator 239.

The user interface 202 has a keypad 250, five user switches 251, 252, 253, 254, 255, each having an associated indicator (not shown), a visual display unit provided by a liquid crystal display 256 and an alarm indicator in this case a buzzer 257. Each of the switches 251, 252, 253, 254, 255 has an associated switch circuit 270 provided so that medical personnel may interrupt the normal oscillation of the patient support platform to perform a specific task such as rasing or lowering the head or feet.

Figure 20:
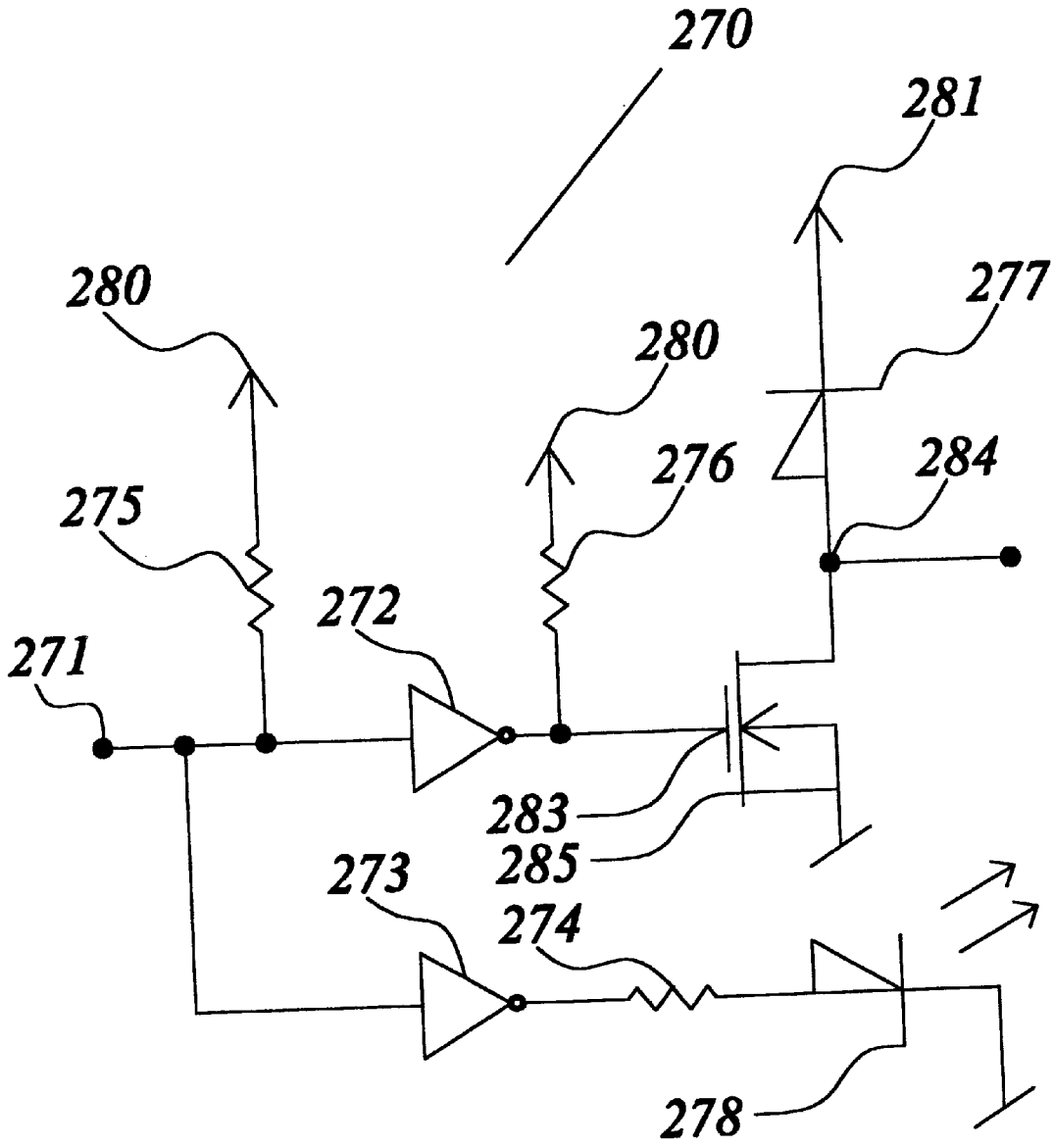
FIG. 20 is a schematic diagram of a switch circuit forming part of the controller.

Referring now to FIG. 20 there is illustrated one of the switch circuits 270, in this case the circuit responding to a user operating the "head up" function by pressing the switch 251 to move the patient support platform raising the patients head. Each of the switches 251–255 has a similar circuit to control the appropriate function.

The switch circuit 270 is connected between the logic unit 205 and the solenoid 240 and has an input pin 271, two inverters 272, 273, three resistors 274, 275, 276, a diode 277, a light emitting diode 278 a mosfet 279 having a gate 283, a drain 284 and a source 285. The switch circuit 270 is powered by a five volt power supply 280 and a twenty four volt power supply 281. The input pin 271 is connected to the inputs of the inverters 272, 273. The output of the inverter 273 feeds through the resistor 274 and the light emitting diode 278 to ground. The input of the inverter 272 is also connected through the resistor 275 to the 5V power supply 280. The output of the inverter 272 is also connected to the 5V power supply 280 through the resistor 276 and feeds the gate 283. The source 285 is tied to ground and the drain is connected to one of the solenoids 240–244 and the 24V power supply 281 through the diode 277.

Figure 21:
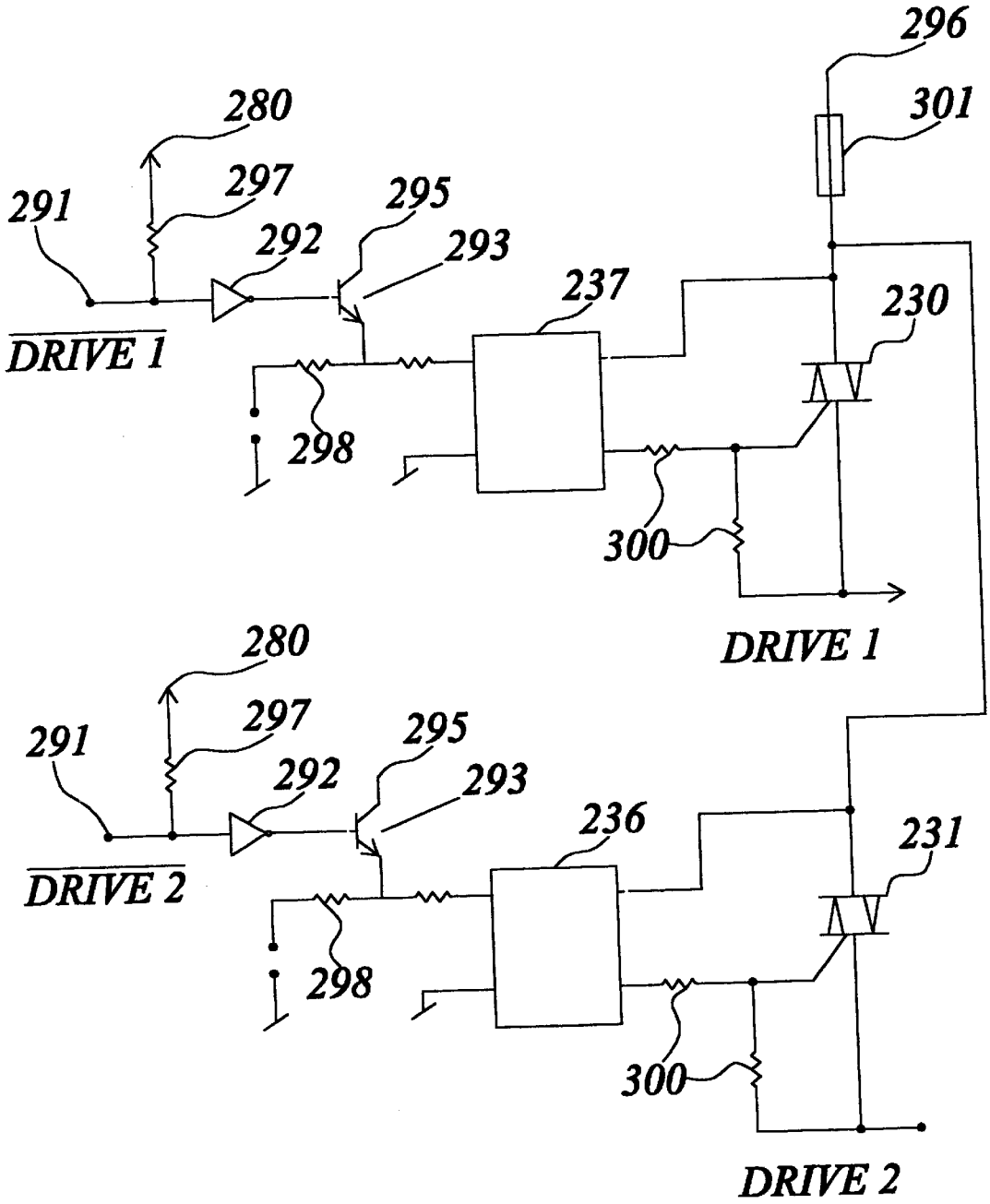
FIG. 21 is a schematic diagram of a motor drive circuit forming part of the controller.

Referring now to FIG. 21 there is illustrated a motor drive circuit 290. In normal operation the logic unit 205 generates timed signals to the drive circuit 290 to provide the patient support platform 2 with the required oscillating motion. While patient support platform 2 is oscillating within a main bed frame 3 on the pivot mountings 4 the logic unit 205 can also be configured to maintain the patient support platform 2 at a Trendelenburg or reverse Trendelenburg angle to aid traction or fluid drainage.

The motor drive circuit 290 has two identical branches only one branch which is active at any one time, each branch being connected between the output of the logic unit 205 and the electrical motor 222. The drive circuit 290 has an input pin 291, an inverter 292, a transistor 293, a twelve volt power supply 295, a one hundred and ten volt power supply 296 and five resistors 297, 298, 299, 300, 301.

The input pin 291 is connected to the input of the inverter 292 and through the resistor 297 to the 5V power supply 280. The output of the inverter 292 feeds the base of the transistor 293 controlling the transistor 293 having the collector connected to the 12V supply 295 and the emitter connected through the resistor 298 to ground. The emitter of the transistor 293 is also connected to the optical isolator 237 configured for normal operation having the control output connected to and controlling the operation of the triac 230 in turn connected to the 110V supply 296.

Figure 22:
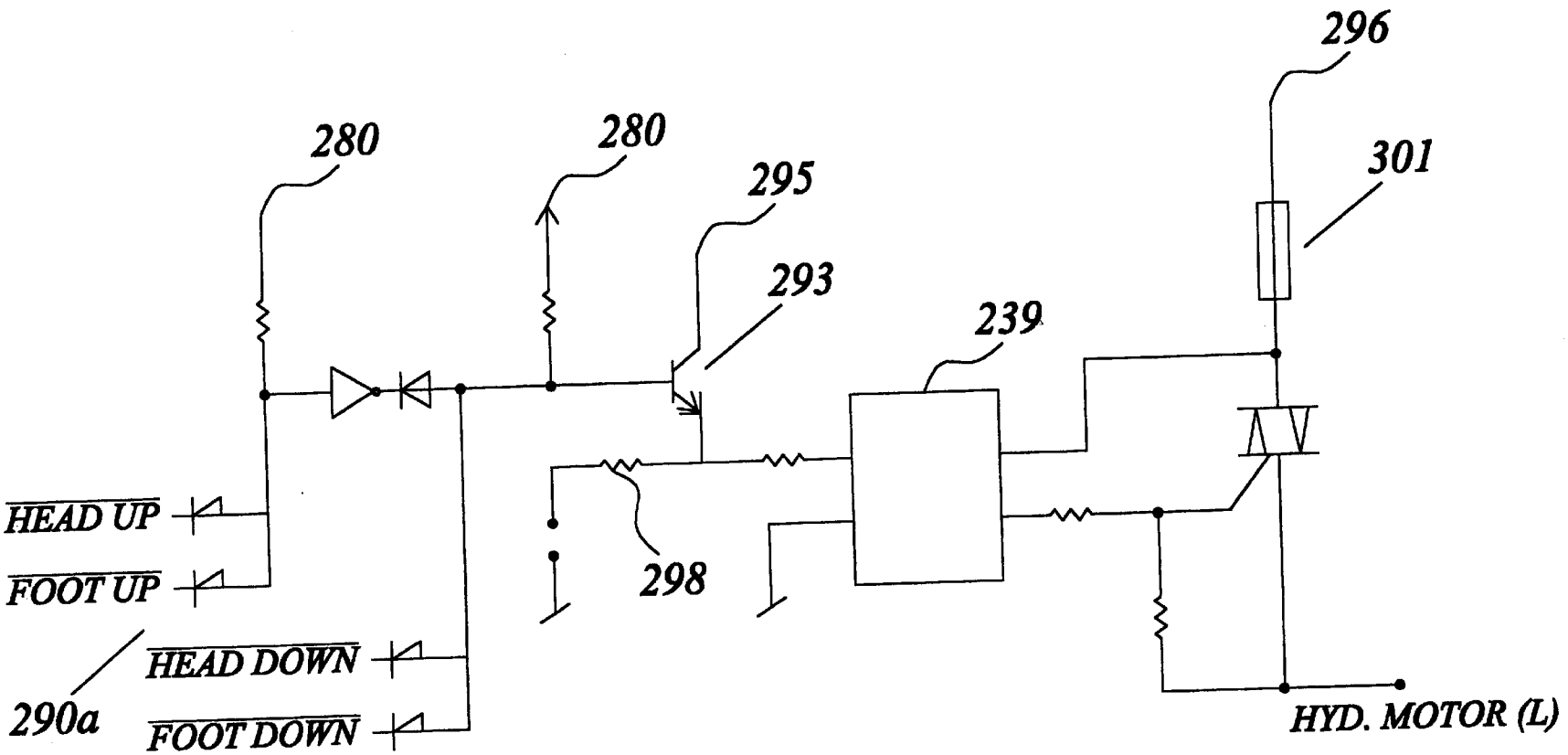
FIG. 22 is a schematic diagram of a pump drive circuit forming part of the controller.

Referring now to FIG. 22 there is illustrated a pump drive circuit configured in the same manner as each of the branches of the drive circuit 290 connected between the logic unit 205 and the hydraulic pump 223 to drive the hydraulic pump 223 in response to a user entry at the user interface 202. In addition to the drive circuitry there is shown a logic function circuit 290*a* connected to the input pin 291 to ensure that contradictory user inputs may not be entered at the user interface 202.

In normal use the patient is securely strapped to the bed and the controller maintains controlled oscillation of the patient support platform with or without a Trendelenburg/reverse Trendelenburg angle. Accurate control of the relative movement between the patient support platform and the bed support is provided by the controller 203.

The controller 203 monitors movement and position of the patient support platform by receiving status signals from the rotary encoders 206, 207 into the logic unit 205 and generating appropriate actuation. The signal from the rotary encoder 206 is generated as the patient support platform moves, when the weight of the pendulum causes the axle 210*a* and therefore the disk 210 to move relative to the infra-red beam passing between the transmitter 208 and the receiver 209. As the disk 210 moves through the beam the segments break the beam causing a signal to be sent to the logic unit.

In response to the signals from the rotary encoders 206, 207 the logic unit sends signals to the electrical motor 222 and the hydraulic pump motor 223. The logical functions governing control of this motion are stored in the logic unit 205.

In normal operation a drive signal is placed on one of the branches of the drive circuit 290 to provide the required motion for the patient support platform. When the bed has moved from one extreme angle to the other in a given time for example from an incline of sixty two degrees from the horizontal on one side to the same angle on the opposite side in approximately four and a half minutes and a suitable timeout period between direction changes for example ten seconds has elapsed the logic one held on the input pin 291 during the previous half oscillation is changed to a logic zero.

This presents a logic zero to the inverter 292 changing the output from a logic zero to a logic one. This in turn allows current to flow from the 12V supply through the transistor 293 and into the optical isolator 237. The output of the optical isolator 237 changes effectively short circuiting the triac 230 and allowing current to flow from the 110V power supply to the electrical motor 222.

If during the movement of the patient support platform relative to the bed support an obstruction is detected by the rotary encoders 206, 207 while moving away from the horizontal position the patient support platform is returned to the horizontal position, the buzzer 257 sounds an alarm condition and the liquid crystal display 256 is updated by the logical unit 205 with a description of the alarm condition and oscillation motion is suspended.

If the encoders 206, 207 detect an obstruction during the movement of the patient support platform, by failure of the axle 210*a* to move within a given time period, while moving from the extreme angle the generated drive signal at the input pin 291 is removed by the logical unit 205 and the alarm signalled as before.

In this way information is being continuously updated, from the rotary encoders 206, 207 allowing the movement of the bed to be easily changed in the event of an error condition due to a block or in response to a user interrupt generated by pressing one of the user switches 251–255. When medical personnel wish to elevate a patients head or feet they press the appropriate user switch 251–255 which the normal input generated by the logic unit 205 and placed on the input pin 271 from a logic one to a logic zero. This changes the input signal to the inverters 272, 273 from a logic one to a logic zero. Accordingly the output logic from each of the inverters 272, 273 changes from a logic zero to a logic one. The logic one output from the inverter 273 passes through and illuminates the light emitting diode 278 indicating that the operation is under way additionally, the current angle is taken from the sensors 206, 207 and fed to the liquid crystal display 256 to show status of the patient support platform.

The logical function (see FIG. 22) prevents two contradictory user switches 251–255 for example "head up" and "head down" from being acted upon simultaneously. In the event that two contradictory user switches 251–255 are pressed simultaneously no action is taken by the logic unit 205.

It will also be appreciated that the logic unit may be configured to allow a controlled lengthwise movement of the bed and the switch lockout logic preventing contradictory instructions may be varied to permit certain combinations such as "head up" and "foot down".

It will be noted that both of the rotary sensors may be configured in the same manner or that different types of sensors may be used.

It will further be noted that the control system may incorporate an "acclimatise" mode which will allow the patient to be become slowly trained to the oscillation of the bed by beginning the oscillation at a low angle and incrementing the oscillation by a small amount in each subsequent oscillation. Additionally as the logic unit incorporates a number of timers these may be used intermittently or during each pass to fix the bed at any given angle for any desired period of time.

The invention is not limited to the embodiments hereinbefore described which may be varied in construction and detail.

What is claimed is:

1. A therapeutic bed comprising a patient support platform pivotally mounted to a main bed frame, a motor drive for oscillating the patient support platform relative to the main bed frame, a normally engaged drive connection between the motor drive and the patient support platform, and actuating means for engaging and disengaging the drive connection, wherein the actuating means comprises a release mechanism having biasing means which urges the release mechanism into a normally engaged position in which the drive connection is engaged, the release mechanism being movable against the bias of the biasing means into a disengaged position in which the drive connection is disengaged.

2. A therapeutic bed as claimed in claim 1 wherein the release mechanism comprises at least one disengagement arm having a handle, the arm being biassed into a normally engaged position.

3. A therapeutic bed as claimed in claim 2 wherein the release mechanism comprises a pair of disengagement arms.

4. A therapeutic bed as claimed in claim 3 wherein the disengagement arms are interconnected by a scissors linkage.

5. A therapeutic bed as claimed in claim 3 wherein the drive connection is connected to disengagement arms adjacent the free ends thereof.

6. A therapeutic bed as claimed in claim 3 wherein the disengagement arms are movable between inner and outer limit stops which limit the movement of the arms.

7. A therapeutic bed as claimed in claim 6 wherein, in the normally engaged position, the disengagement arms engage the inner stops.

8. A therapeutic bed as claimed in claim 1 wherein the drive connection comprises a drive belt, and wherein the tension of the drive belt is adjustable by an adjustment means.

9. A therapeutic bed as claimed in claim 8 wherein the adjustment means comprises a turnbuckle.

10. A therapeutic bed as claimed in claim 1 having means for mounting a photographic cassette adjacent an upper side of the patient support platform.

11. A therapeutic bed as claimed in claim 10 wherein the mounting means has means for demountably loading the cassette on the patient support platform from an underside of the patient support platform.

12. A therapeutic bed as claimed in claim 1 having a patient support pad mounted on the bed by a mounting means which is operable for movement of the pad in two separate directions for positional adjustment of the pad relative to the patient support platform, and locking means for releasably locking the pad on the bed.

13. A therapeutic bed as claimed in claim 12 wherein the locking means comprises and associated pair of cams, each cam for controlling movement of the pad in one of the directions, the cams having a common operating lever for simultaneous movement of both cams between an engaged locking position and a released position.

14. A therapeutic bed as claimed in claim 1 having a delicate instrument mounting bracket mounted on the bed at or adjacent a longitudinal axis of the bed.

15. A therapeutic bed as claimed in claim 1 having a control system including a use interface for entry of desired parameters, a controller for controlling movement of the patient support platform relative to the bed support and drive means for actuating movement of the patient support platform in response to a signal from the controller.

16. A therapeutic bed as claimed in claim 15 wherein the controller has a logic unit communicating with the user interface and the drive means, the logic unit having at least two sensors for determining patient support table status.

17. A therapeutic bed as claimed in claim 16 wherein at least one sensor is a rotary encoder.

18. A therapeutic bed as claimed in claim 17 wherein the rotary encoder incorporates an optical interruptor with an associated motion detector.

19. A therapeutic bed as claimed in claim 18 wherein the motion detector is a pendulum for actuating the optical interrupter in response to a movement of the controlled object.

20. A therapeutic bed comprising a patient support platform pivotally mounted to a main bed frame, a motor drive for oscillating the patient support platform relative to the main bed frame, a drive connection, and actuating means for engaging and disengaging the drive connection, wherein the actuating means comprises a release mechanism which is biased into a normally engaged position, the release mechanism comprises a pair of disengagement arms with at least one of the pair of disengagement arms having a handle, the at least one arm being biased into a normally engaged position.

* * * * *